US005688596A

United States Patent [19]

Makino et al.

[11] Patent Number: 5,688,596

[45] Date of Patent: Nov. 18, 1997

[54] AROMATIC POLYAMIDE FILAMENT HAVING AN ENHANCED WEATHERING RESISTANCE

[75] Inventors: Osamu Makino; Toshitsugu Matsuki; Toshihiro Santa, all of Matsuyama, Japan

[73] Assignee: Teijin Limited, Osaka, Japan

[21] Appl. No.: 407,805

[22] Filed: Mar. 20, 1995

Related U.S. Application Data

[63] Continuation of Ser. No. 57,096, May 4, 1993, abandoned.

[30] Foreign Application Priority Data

May 7, 1992 [JP] Japan ..... 4-114812

[51] Int. Cl.[6] ..... B32B 15/00

[52] U.S. Cl. ..... 428/379; 428/361; 428/364; 428/373; 428/385; 428/386; 428/402; 428/403; 260/DIG. 21; 260/DIG. 23; 260/DIG. 30

[58] Field of Search ..... 428/373, 361, 428/364, 375, 379, 385, 386, 396, 402, 403

[56] References Cited

U.S. PATENT DOCUMENTS

| | | | |
|---|---|---|---|
| 3,043,709 | 7/1962 | Amborski . | |
| 3,102,323 | 9/1963 | Adams | 260/40 |
| 3,320,207 | 5/1967 | Roth et al. | 260/45.95 |
| 3,773,884 | 11/1973 | Shimosaka et al. . | |
| 3,888,821 | 6/1975 | Milford, Jr. . | |
| 4,075,172 | 2/1978 | Ozawa et al. . | |
| 5,401,562 | 3/1995 | Akao | 428/211 |

FOREIGN PATENT DOCUMENTS

| | | |
|---|---|---|
| 0121132 | 6/1984 | European Pat. Off. . |
| 0200472 | 4/1986 | European Pat. Off. . |
| 0228224 | 12/1986 | European Pat. Off. . |
| 1217092 | 9/1960 | France . |
| 2205588 | 10/1973 | France . |
| 2550518 | 12/1977 | Germany . |
| A49100322 | 9/1974 | Japan . |
| 59-1798 | 3/1984 | Japan . |
| 022292 | 7/1990 | Japan . |
| 2178324 | 7/1990 | Japan . |
| A2178324 | 7/1990 | Japan . |
| A2229281 | 9/1990 | Japan . |
| T3505610 | 12/1991 | Japan . |
| 1501948 | 2/1978 | United Kingdom . |

*Primary Examiner*—Merrick Dixon

*Attorney, Agent, or Firm*—Burgess, Ryan & Wayne

[57] ABSTRACT

An aromatic polyamide filament includes extremely fine inorganic material having a high refractive index of 2.0 or more and an extremely fine average particle size of 0.3 μm or less and dispersed, in an amount of 0.1 to 5% based on the total weight of the filament, in at least a surface portion of an aromatic polyamide filament matrix; has an individual filament thickness of 0.5 to 50 deniers, a tensile strength of 18 g/d or more, an ultimate elongation of 3.5% or more and an initial modulus of 450 g/d; and exhibits an enhanced weathering resistance derived from the high ultraviolet ray-reflecting, shielding and absorbing properties of the extremely fine inorganic particles dispersed in the filament matrix.

3 Claims, No Drawings

AROMATIC POLYAMIDE FILAMENT HAVING AN ENHANCED WEATHERING RESISTANCE

This application is a continuation of application Ser. No. 08/057,096, filed May 4, 1993 now abandoned May 1, 1995.

BACKGROUND OF THE INVENTION

1. Field of the Invention

The present invention relates to an aromatic polyamide filament having an enhanced weathering resistance.

2. Description of Related Art

It is known that aromatic polyamide filaments, particularly p-oriented aromatic polyamide filaments have excellent dynamic properties and thus are useful as industrial fibers for various uses.

Nevertheless, the conventional aromatic polyamide filaments are not always satisfactory in weathering resistance thereof, and therefore, when used while being exposed to sunlight, the mechanical properties of the aromatic polyamide filaments are deteriorated. Although the mechanism of the deterioration has not yet been completely made clear, it is assumed that the amide structures in the aromatic polyamide molecules are broken down by a photochemical reaction in the presence of water, and a Fries rearrangement reaction and/or a production of radicals due to oxidation occurs, to decompose the aromatic polyamide.

Accordingly, when the conventional aromatic polyamide filaments are used to produce an industrial fiber material, for example, a rope or net, the resultant material must be protected by covering it with a weathering-resistant fiber or resin coating, to restrict the possible deterioration of the material under weathering. Especially, where the aromatic polyamide filaments having a small thickness are utilized for forming a sporting wear having a light weight and a high mechanical strength, there is a strong demand for providing a new type of aromatic polyamide filaments having an enhanced weathering resistance.

There were attempts to enhance the weathering resistance of the aromatic polyamide fiber by various means. However, those attempts were not always successful in attaining the above-mentioned purpose.

For example, U.S. Pat. No. 3,888,821 discloses a process for producing a weathering-resistant aromatic polyamide filament by uniformly dispersing an ultraviolet ray-absorbing agent comprising, for example, a benztriazole compound or a substituted benzophenone compound, in an amount of 2 to 6% based on the weight of the aromatic polyamide filament, into an aromatic polyamide matrix, while preventing an aggregation of the ultraviolet ray-absorbing agent into agglomerative particles having a size of 0.01 μm or more. This process is, however, disadvantageous not only in that when the resultant aromatic polyamide filament is treated at a high temperature, the ultraviolet ray-absorbing agent in the filament is thermally deteriorated.

Japanese Unexamined Patent Publication (Kokai) No. 2-229,281 discloses a method of producing a light-resistant aromatic polyamide filament containing 0.02 to 10% by weight of a light-fading pigment which can compensate for a discoloration of the filament due to light applied to the filament. This method is very difficult in principle to realize and thus is disadvantageous in that the application of this method is limited to only a specific color in which the filament is discolored.

Japanese Unexamined Patent Publication (Kokai) No. 2-178,324 discloses a method of enhancing the weathering resistance of the aromatic polyamide filament, in which method, the amide structures in the aromatic polyamide molecules are modified into an imide structure by an N-aromatic acylation. This method is disadvantageous in that the acylation of the amide structures must be carried out with a specific acylating agent, for example, benzoyl chloride, in an organic solvent in which the aromatic polyamide is dissolved, and thus the procedures necessary for producing the modified aromatic polyamide fiber becomes undesirably long and complicated.

SUMMARY OF THE INVENTION

An object of the present invention is to provide an aromatic polyamide filament having a high mechanical strength and an enhanced weathering resistance.

In the present invention, it has been discovered that the weathering resistance of the aromatic polyamide filament can be enhanced by dispersing extremely fine inorganic particles having a specific refractive index and a very small average size, in at least a surface portion of the aromatic polyamide filament.

The aromatic polyamide filament of the present invention comprises a filament matrix comprising at least one aromatic polyamide and a plurality of extremely fine inorganic particles having a refractive index of 2.0 or more and an average particle size of 0.3 μm or less, and dispersed, in an amount of 0.1% to 5% based on the total weight of the filament, in at least a surface portion of the filament matrix, said filament having an individual filament thickness of 0.5 to 50 deniers, a tensile strength of 18 g/denier or more, an ultimate elongation of 3.5% or more and an initial modulus of 450 g/denier or more.

The above-mentioned aromatic polyamide filament preferably produced by a process of the present invention comprising the steps of producing an undrawn aromatic polyamide filament by a wet spinning method; coating a surface of the undrawn aromatic polyamide filament with an aqueous colloidal dispersion of extremely fine inorganic particles having a refractive index of 2.0 or more and an average particle size of 0.3 μm or less, in a dry weight of 0.1% to 5% based on the total weight of the coated undrawn filament; drying the resultant aqueous colloidal dispersion layer on the undrawn filament; and drawing the resultant dried undrawn filament coated with the dried extremely fine inorganic particles to an extent such that the extremely fine inorganic particles are allowed to penetrate into at least surface portion of the filament, and the resultant drawn filament obtains a thickness of 0.5 to 50 deniers, a tensile strength of 18 g/denier or more, an ultimate elongation of 3.5% or more and an initial modulus of 450 g/denier or more.

The term "initial modulus" of a filament refers to a gradient in g/denier of a stress-strain curve at an initial elongation (stress) of 1%, of the filament. The initial modulus of the filament can be determined from a stress-strain curve of the filament.

DESCRIPTION OF THE PREFERRED EMBODIMENTS

The aromatic polyamide filament of the present invention comprises a filament matrix comprising at least one aromatic polyamide and a plurality of extremely fine inorganic particles dispersed in at least a surface portion of the filament matrix.

The aromatic polyamide usable for the present invention preferably comprises 80 to 100 molar %, more preferably 90 to 100 molar %, of principal recurring units of the formula (I):

$$-NH-Ar_1-NHCO-Ar_2-CO- \quad (I)$$

wherein $Ar_1$ and $Ar_2$ respectively and independently from each other represent a member selected from the group consisting of divalent aromatic groups of the formulae:

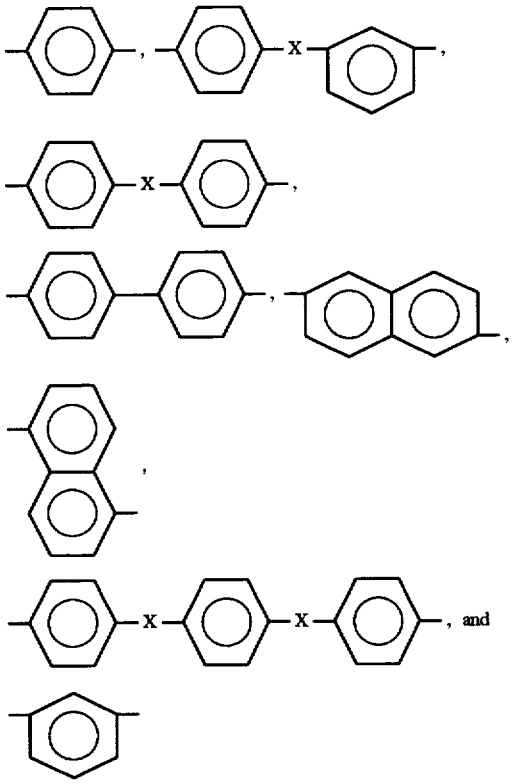

and X represents a member selected from the group consisting of divalent atoms and groups of the formulae:

$$-O-,\ -\underset{\underset{O}{\|}}{C}-,\ -S-,\ -\overset{\overset{O}{\|}}{\underset{\underset{O}{\|}}{S}}-,\ -CH_2-,\ \text{and}\ -CONH-$$

and 0 to 20 molar %, more preferably 0 to 10 molar %, of additional recurring units different from those of the formula (I).

In the above-mentioned aromatic polyamide usable for the present invention, the additional recurring units are preferably selected from those of the formulae:

$$-NH-Ar-CO-,$$

and $$-NH-R-CO-$$

wherein Ar represents a divalent aromatic group and R represents a divalent aliphatic group.

The aromatic polyamide usable for the present invention can be produced by the methods disclosed in British Patent No. 1,501,948, U.S. Pat. No. 4,075,172 or Japanese Unexamined Patent Publication (Kokai) No. 49-100,522.

The extremely fine inorganic particles may be distributed throughout the filament matrix or only in the surface portion of the filament matrix.

The extremely fine inorganic particles are preferably concentrated in the surface portion of the filament matrix. More preferably, the surface portion of the filament matrix in which the extremely fine inorganic particles are locally distributed has a depth (thickness) corresponding to 10% or less, still more preferably 5% or less of the thickness of the filament.

Where the extremely fine inorganic particles are distributed throughout the filament matrix with respect to the cross-section thereof, namely not only in the surface portion but also in the inside portion of the filament matrix, the portion of the extremely fine inorganic particles located inside of the filament matrix is not contributory thereby to reflect or absorb ultraviolet rays and to protect the aromatic polyamide filament matrix, and thus the contribution efficiency of the extremely fine inorganic particles contained in the filament matrix is poor. To increase the reflection and absorption of the ultraviolet rays at the surface portion of the filament matrix, it is necessary to increase a concentration of the extremely fine inorganic particles dispersed in the filament matrix. When the extremely fine inorganic particles are dispersed in a high concentration, in the filament matrix, the resultant aromatic polyamide filament is affected in the mechanical strength thereof. Accordingly, in this case, close attention should be paid to the size of the inorganic particles and an undesirable aggregation of the inorganic particles should be avoided.

As mentioned above, the extremely fine inorganic particles effectively reflect, shield and/or absorb ultraviolet rays irradiated to the filament to protect the filament from deterioration. Accordingly, the extremely fine inorganic particles are preferably dispersed substantially only in the surface portion of the filament matrix.

The production of the aromatic polyamide filament in which the extremely fine inorganic particles are located only in the surface portion of the filament matrix, can be carried out in the following manner.

(1) A core-in-sheath type composite filament is produced from a core filamentary aromatic polyamide resin dope solution stream free from the inorganic particles and a sheath filamentary aromatic polyamide resin dope solution in which a plurality of extremely fine inorganic particles are dispersed.

(2) The filament matrix is impregnated with the extremely fine inorganic particles by an impregnation procedure similar to a dyeing procedure.

(3) The extremely fine inorganic particles are imparted to a surface of a swollen aromatic polyamide filament matrix and then the resultant composite filament is dried and shrunk so as to allow the inorganic particles to penetrate into the filament body.

(4) The extremely fine inorganic particles are adhered on a surface of an aromatic polyamide filament matrix by utilizing a static charge, and then the adhered inorganic particles are fixed on the filament surface by a fuse-bonding or adhesive agent.

(5) A surface of an aromatic polyamide filament matrix is coated with a blend of an aromatic polyamide resin with extremely fine inorganic particles in a high concentration.

In a preferable process for producing the aromatic polyamide filament containing extremely fine inorganic particles distributed in a surface portion of the filament, an undrawn aromatic polyamide filament (matrix) is produced by a wet spinning (filament-forming) method; a surface of the undrawn filament is coated with an aqueous colloidal solution of extremely fine inorganic particles having a refractive index of 2.0 or more and an average particle size of 0.3 μm or less, in a dry weight of 0.1% to 5% based on the total weight of the coated undrawn filament; the resultant aqueous colloidal dispersion layer on the undrawn filament is dried; and the resultant undrawn filament coated with the dried extremely fine inorganic particles to an extent such that the extremely fine inorganic particles are allowed to penetrate into at least the surface portion of the filament (matrix), and the resultant drawn filament exhibits a thickness of 0.5 to 50 deniers, a tensile strength of 18 g/denier or more, an ultimate elongation of 3.5% or more and an initial modulus of 450 g/denier.

In the above-mentioned process, preferably, the drying step is carried out at a temperature of 200° C. to 300° C. for 0.2 to 1.0 minutes, and the drawing step is carried out at a draw ratio of 5 to 20 at a temperature of 450° C. to 550° C.

The inorganic particles usable for the present invention have a refractive index of 2.0 or more, preferably 2.4 or more. Generally, the following relationship exists between a reflectance and a refractive index:

$$\rho=((n2-n1)/(n2+n1))^2$$

wherein ρ represents a reflectance of light by a substance, n1 represents a refractive index of light by a surface portion of the substance and n2 represents a refractive index of light by an inside portion of the substance.

Accordingly, when the refractive index of the inorganic particles is less than 2.0, the reflaction coefficieny of the inorganic particles for ultraviolet rays at the surface of the resultant aromatic polyamide filament becomes low, and thus the resultant filament exhibits an unsatisfactory resistance to ultraviolet rays and thus is easily deteriorated when exposed to ultraviolet rays.

The inorganic particles having a refractive index of 2.0 or more are preferably selected from the group consisting of rutile titanium dioxide, anatase titanium dioxide, zinc oxide, cadmium red, red mercuric sulfide, red iron oxide, middle chrome yellow, cadmium yellow, yellow iron oxide and chrome vermilion.

The inorganic particles usable for the present invention have an average particle size of 0.3 μm or less. When the average particle size is more than 0.3 μm, the inorganic particles serve as injurious foreign matter which causes the resultant individual filament to be broken and the resultant filament yarn to be fluffed and/or broken.

The inorganic particles are dispersed, in an amount of 0.1% to 5% based on the total weight of the resultant filament, in the filament matrix. When used in an amount of less than 0.1%, the inorganic particles dispersed in the filament matrix exhibit an unsatisfactory reflection and shielding effect to ultraviolet rays. Also, when used in an amount of more than 5.0%, the inorganic particles serve as an injurious foreign matter so as to lower the mechanical properties of the resultant filament.

The aromatic polyamide fiber containing the extremely fine inorganic particles has a thickness of 0.5 to 50 deniers (0.56 dtex to 55.56 dtex). When the thickness is less than 0.5 denier, the inorganic particles serve as an injurious foreign matter to the filament matrix, and thus the wet-spinning step for the filament becomes unstable. Also, the decrease in the thickness of the filament results in an increase in specific surface area of the filament. The increase in specific surface area of the filament results in an increase in deterioration rate of the filament when exposed to light (ultraviolet rays). To avoid the deterioration of the filament due to the ultraviolet rays, the amount of the inorganic particles to be added to the filament matrix must be increased. The increased amount of the inorganic particles serve as an injurious foreign matter to the filament matrix and cause the resultant filament to exhibit lowered mechanical properties thereof. Also, the wet-spinning and drawing steps become unstable.

When the thickness is more than 50 deniers, the resultant filament has a reduced specific surface area and an enhanced resistance to ultraviolet rays. However, the reduced specific surface area causes the coagulation of wet-spun filament to be incomplete and thus the water-rinsing step and drawing step for the coagulated filament become unstable and the resultant filament exhibits unsatisfactory physical properties.

The aromatic polyamide filament has a tensile strength of 18 g/denier or more. It is preferable that the tensile strength of the filament be as high as possible. Generally, the tensile strength of the filament is lowered with an increase in the content of the inorganic particles. If the tensile strength is less than 18 g/denier, the resultant filament is unsatisfactory as an aromatic polyamide filament.

The aromatic polyamide filament of the present invention has an ultimate elongation of 3.5% or more. If the ultimate elongation is less than 3.5%, the resultant filament exhibits a large twist strain when twisted, and thus a resultant twisted cord exhibits a lowered utilization efficiency in terms of strength of the filament.

The aromatic polyamide filament of the present invention has an initial modulus of 450 g/denier or more. If the initial modulus is less than 450 g/denier, the resultant filament is unsatisfactory as a high modulus aromatic polyamide filament.

EXAMPLES

The present invention will be further explained by the following specific examples.

In the examples, a polymer dope solution to be subjected to a wet-spinning procedure was prepared by a solution polymerization method as follows.

Preparation of dope solution

A reaction vessel equipped with an inlet and outlet for flowing a nitrogen gas through the vessel and anchor-shaped stirring wings was charged with 205 liters of N-methyl-2-pyrrolidone (NMP) having a water content of about 20 ppm, and then p-phenylenediamine in a precision weight of 2,764 g and 3,4'-diaminodiphenylether in a precision weight of 5,114 g were added to and dissolved in NMP. The resultant solution was stirred at a rate of revolution of 64 turns/min at a temperature of 30° C., and then terephthalic acid chloride in a precision weight of 10,320 g was added to the solution while stirring. After the temperature of the resultant reaction mixture was raised to a temperature of 53° C. due to a reaction heat, the stirring operation was continued at this temperature for one hour, then the reaction temperature was raised to 85° C. and the stirring operation was further continued at 85° C. for 15 minutes. When the viscosity of the reaction mixture reached a peak, the polymerization procedure was completed. Then, a slurry of 22.5% of weight of calcium hydroxide in NMP as added in an amount of 16.8 kg to the reaction mixture and the resultant admixture was stirred for 20 minutes. After the pH of the admixture was adjusted to 5.4, the admixture was filtered through a filter having perforations with a size of 20 μm.

The resultant product was a spinning dope solution having a concentration of the aromatic polyamide of 6% by weight.

Comparative Example 1

The above-mentioned spinning dope solution was extruded, in accordance with a dry-jet spinning method, through a spineret provided with 1000 spinning orifices each having a circular cross-sectional profile and an inside diameter of 0.3 mm, at an extrusion rate of 1350 g/min at a dope solution temperature of 107° C. The extruded filamentary streams of the spinning dope solution were introduced into and coagulated in a coagulation liquid consisting of 30% aqueous solution of NMP. The coagulated undrawn filaments were withdrawn at a velocity of 47 m/min from the coagulation liquid, and rinsed with water. The rinsed undrawn filaments were surface-coated with a hydrated gel-forming aqueous dispersion of 10% by weight of mixed maguesium silicate and aluminum silicate particles.

The amount of the mixed particles was 1.8% based on the total dry weight of the resultant coated filaments. The resultant filaments were dried at a temperature of 220° C. for 0.4 minutes, and heat-drawn at a temperature of 530° C. at a draw ratio of 10.6. The resultant drawn multi-filaments were taken up at a velocity of 500 m/min. The resultant drawn multifilament yarn had a yarn count of 1502 deniers/1000 filaments, a total yarn tensile strength of 42.7 kg, an individual filament tensile strength of 28.4 g/denier, an ultimate elongation of the filament of 4.54%, and an initial modulus of the filament of 577 g/denier.

The filament yarn was subjected to a sunshine weathering test at a temperature of 63° C. for 300 hours. The retained tensile strength of the tested filament yarn was 16.8 kg, the retention of the tensile strength of the filament yarn was 39%.

Also, the filament yarn was subjected to a carbon arc light weathering test at a temperature of 63° C. for 300 hours. The retained tensile strength of the tested filament yarn was 17.9 kg and the tensile strength retention was 42%.

Example 1

An aromatic polyamide multifilament yarn was produced by the same procedures as in Comparative Example 1, except that the hydrated gel dispersion contained 2% by weight of extremely fine rutile titanium dioxide particles surface-coated with silica, having a refractive index of about 2.7, and an average particle size of 0.02 μm, and the dry amount of the rutile titanium dioxide particles coated on the filament surfaces was 0.25% based on the total weight of the coated filament yarn.

The resultant aromatic polyamide multifilament yarn had a yarn count of 1503 deniers/1000 filaments, a total yarn tensile strength of 43.3 kg, an individual filament tensile strength of 28.8 g/denier, an ultimate elongation of filament of 4.60% and an initial modulus of 583 g/denier.

It was confirmed by an XMA that the titanium dioxide particles were distributed within surface portions of the filaments having a depth (thickness) corresponding to 5% or less of the radius of the circular cross-sectional profiles of the filaments.

The results of the sunshine weathering test (63° C., 300 hours) were as follows.

Retained tensile strength of the tested yarn: 21.5 kg

Retention of the tensile strength: 50%

The results of the carbon arc light weathering test (63° C., 300 hours) were as follows.

Retained tensile strength of the tested yarn: 21.2 kg

Retention of tensile strength: 49%

Example 2

An aromatic polyamide multifilament yarn was produced by the same procedures as in Comparative Example 1, except that the aromatic polyamide dope solution was mixed with a slurry of extremely fine rutile titanium dioxide particles surface-coated with alumina-silica and having a refractive index of about 2.7 and an average particle size of 0.04 μm, in NMP. The dry amount of the futile titanium dioxide particles was 3.0% based on the total weight of the polymer.

The resultant aromatic polyamide multifilament yarn had a yarn count of 1509 deniers/1000 filaments, a total yarn tensile strength of 38.8 kg, an individual filament tensile strength of 25.7 g/denier, an ultimate elongation of filament of 4.43% and an initial modulus of 571 g/denier.

It was confirmed by an XMA that the titanium dioxide particles were uniformly distributed throughout the cross-section of the filaments.

The results of the sunshine weathering test (63° C., 300 hours) were as follows.

Retained tensile strength of the tested yarn: 18.6 kg

Retention of the tensile strength: 48%

The results of the carbon arc light weathering test (63° C., 300 hours) were as follows.

Retained tensile strength of the tested yarn: 17.8 kg

Retention of tensile strength: 46%

Example 3

An aromatic polyamide multifilament yarn was produced by the same procedures as in Comparative Example 1, except that the hydrated gel dispersion contained 3% by weight of extremely fine rutile titanium dioxide particles surface-coated with aluminum oxide, having a refractive index of about 2.7, and an average particle size of 0.05 μm, and the dry amount of the rutile titanium dioxide particles coated on the filament surfaces was 0.34% based on the total weight of the coated filament yarn.

The resultant aromatic polyamide multifilament yarn had a yarn count of 1511 deniers/1000 filaments, a total yarn tensile strength of 42.5 kg, an individual filament tensile strength of 28.1 g/denier, an ultimate elongation of filament of 4.75% and an initial modulus of 598 g/denier.

It was confirmed by an XMA that the titanium dioxide particles were distributed within surface portions of the filaments having a depth (thickness) corresponding to 5% or less of the radius of the circular cross-sectional profiles of the filaments.

The results of the sunshine weathering test (63° C., 300 hours) were as follows.

Retained tensile strength of the tested yarn: 22.1 kg

Retention of the tensile strength: 52%

The results of the carbon arc light weathering test (63° C., 300 hours) were as follows.

Retained tensile strength of the tested yarn: 20.4 kg

Retention of tensile strength: 48%

Example 4

An aromatic polyamide multifilament yarn was produced by the same procedures as in Example 3, except that the dope solution was mixed with 1.5% based on the contained dry weight of the polymer, of carbon black particles having an average primary particle size of 60 μm, and the dry amount of the rutile titanium dioxide particles coated on the filament surfaces was 0.18% based on the total weight of the coated filament yarn.

The resultant aromatic polyamide multifilament yarn had a yarn count of 1531 deniers/1000 filaments, a total yarn tensile strength of 38.0 kg, an individual filament tensile strength of 24.8 g/denier, an ultimate elongation of filament of 4.30% and an initial modulus of 584 g/denier.

It was confirmed by an XMA that the titanium dioxide particles were distributed within surface portions of the filaments having a depth (thickness) corresponding to 5% or less of the radius of the circular cross-sectional profiles of the filaments. Also, it was confirmed by a permeation electron microscope, that carbon black particles were uniformly distributed throughout the filaments.

The results of the sunshine weathering test (63° C., 300 hours) were as follows.

Retained tensile strength of the tested yarn: 30.0 kg

Retention of the tensile strength: 79%

The results of the carbon arc light weathering test (63° C., 300 hours) were as follows.

Retained tensile strength of the tested yarn: 27.0 kg

Retention of tensile strength: 71%

Example 5

An aromatic polyamide multifilament yarn was produced by the same procedures as in Example 4, except that the resultant multifilament yarn was oiled with an oiling liquid containing 2% by weight of a hindered amine compound available under the trademark of CHIMASSORB 944, from Ciba Geigy. The dry amount of the rutile titanium dioxide particles coated on the filament surfaces was 0.14% based on the total weight of the coated filament yarn.

The resultant aromatic polyamide multifilament yarn had a yarn count of 1506 deniers/1000 filaments, a total yarn tensile strength of 34.9 kg, an individual filament tensile strength of 23.2 g/denier, an ultimate elongation of filament of 3.98% and an initial modulus of 589 g/denier.

It was confirmed by an XMA that the titanium dioxide particles were distributed within surface portions of the filaments having a depth (thickness) corresponding to 5% or less of the radius of the circular cross-sectional profiles of the filaments. Also, it was confirmed by a permeation electron microscope, that the carbon black particles were uniformly distributed throughout the filaments.

The results of the sunshine weathering test (63° C., 300 hours) were as follows.

Retained tensile strength of the tested yarn: 28.3 kg

Retention of the tensile strength: 81%

The results of the carbon arc light weathering test (63° C., 300 hours) were as follows.

Retained tensile strength of the tested yarn: 24.4 kg

Retention of tensile strength: 70%

Example 6

An aromatic polyamide multifilament yarn was produced by the same procedures as in Example 5, except that the resultant multifilament yarn was oiled with an oiling liquid containing 2% by weight of a benztriazole type ultraviolet ray-absorbing agent available under the trademark of Tinuvin 213, from Ciba Geigy. The dry amount of the rutile titanium dioxide particles coated on the filament surfaces was 0.20% based on the total weight of the coated filament yarn.

The resultant aromatic polyamide multifilament yarn had a yarn count of 1548 deniers/1000 filaments, a total yarn tensile strength of 39.3 kg, an individual filament tensile strength of 25.4 g/denier, an ultimate elongation of filament of 4.39% and an initial modulus of 564 g/denier.

It was confirmed by an XMA that the titanium dioxide particles were distributed within surface portions of the filaments having a depth (thickness) corresponding to 5% or less of the radius of the circular cross-sectional profiles of the filaments. Also, it was confirmed by a permeation electron microscope that the carbon black particles were evenly distributed throughout the filament.

The results of the sunshine weathering test (63° C., 300 hours) were as follows.

Retained tensile strength of the tested yarn: 31.0 kg

Retention of the tensile strength: 79%

The results of the carbon arc light weathering test (63° C., 300 hours) were as follows.

Retained tensile strength of the tested yarn: 28.7 kg

Retention of tensile strength: 73%

Comparative Example 2

An aromatic polyamide multifilament yarn was produced by the same procedures as in Example 2, except that the extremely fine rutile titanium dioxide particles were replaced by 2% by weight of silica particles having a refractive index of about 1.6 and an average particle size of 0.7 μm, and the dry amount of the silica particles coated on the filament surfaces was 0.35% based on the total weight of the coated filament yarn.

The resultant aromatic polyamide multifilament yarn had a yarn count of 1503 deniers/1000 filaments, a total yarn tensile strength of 32.3 kg, an individual filament tensile strength of 21.5 g/denier, an ultimate elongation of filament of 4.10% and an initial modulus of 523 g/denier.

It was confirmed by an XMA that the silica particles were evenly distributed throughout the filaments.

The results of the sunshine weathering test (63° C., 300 hours) were as follows.

Retained tensile strength of the tested yarn: 13.2 kg

Retention of the tensile strength: 41%

The results of the carbon arc light weathering test (63° C., 300 hours) were as follows.

Retained tensile strength of the tested yarn: 12.9 kg

Retention of tensile strength: 40%

Comparative Example 3

An aromatic polyamide multifilament yarn was produced by the same procedures as in Example 1, except that the hydrated gel dispersion contained 2.0% by weight of fine anatase titanium dioxide particles having a refractive index of about 2.5 and an average particle size of 0.5 μm, and the dry amount of the anatase titanium dioxide particles coated on the filament surfaces was 0.34% based on the total weight of the coated filament yarn.

The resultant aromatic polyamide multi-filament yarn had a yarn count of 1503 deniers/1000 filaments, a total yarn tensile strength of 36.8 kg, an individual filament tensile strength of 24.5 g/denier, an ultimate elongation of filament of 4.65% and an initial modulus of 573 g/denier.

It was confirmed by an XMA that the titanium dioxide particles were distributed within surface portions of the filaments having a depth (thickness) corresponding to 5% or less of the radius of the circular cross-sectional profiles of the filaments.

The results of the sunshine weathering test (63° C., 300 hours) were as follows.

Retained tensile strength of the tested yarn: 13.2 kg

Retention of the tensile strength: 36%

The results of the carbon arc light weathering test (63° C., 300 hours) were as follows.

Retained tensile strength of the tested yarn: 13.6 kg

Retention of tensile strength: 37%

In view of Examples 1 to 6, it is clear that the extremely fine inorganic particles effectively enhance the resistance of the resultant aromatic polyamide filaments to deterioration when exposed to ultraviolet rays.

We claim:

1. An aromatic polyamide filament having an enhanced ultraviolet ray-resistance, comprising a filament matrix having at least one aromatic polyamide and a plurality of extremely fine inorganic particles, wherein:

(1) the aromatic polyamide comprises 80 to 100 molar % of principal recurring units of the formula (I):

$$-NH-Ar_1-NHCO-Ar_2-CO- \quad (I)$$

wherein $Ar_1$ and $Ar_2$ respectively and independently from each other represent a member selected from the group consisting of divalent aromatic groups of the formulae:

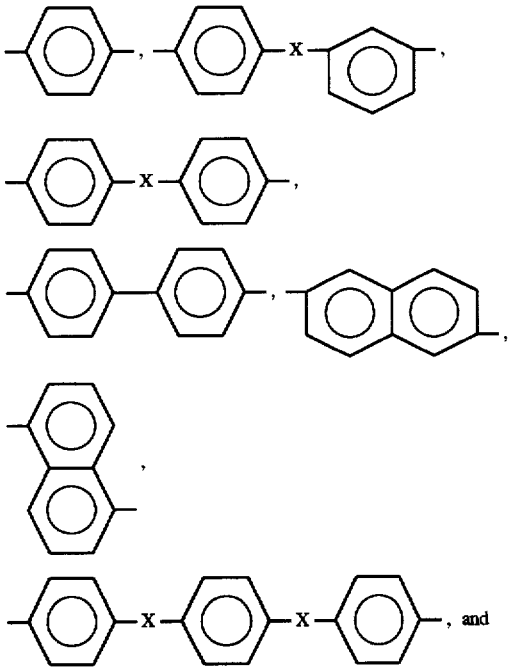

-continued

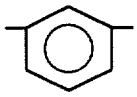

and X represent a member selected from the group consisting of divalent atoms and groups of the formulae:

$$-O-,\ -\underset{\underset{O}{\|}}{C}-,\ -S-,\ -\underset{\underset{O}{\|}}{\overset{\overset{O}{\|}}{S}}-,\ -CH_2,\ \text{and}\ -CONH-$$

and 0 to 20 molar % of additional recurring units different from those from those of the formula (I);

(2) the extremely fine inorganic particles are selected from the group consisting of rutile titanium dioxide, anatase titanium dioxide, zinc oxide, cadmium red, red mercuric sulfide, red iron oxide, middle chrome yellow, cadmium yellow, yellow iron oxide and chrome vermilion particles having a refractive index of 2.0 or more and an average particle size of 0.3 μm or less, and dispersed in an amount 0.1% to 5% based on the total weight of the filament, only in a surface portion of the filament matrix; and (3) the filament has an individual filament thickness of 0.5 to 50 deniers, a tensile strength of 18 g/denier or more, an ultimate elongation of 3.5% or more, and an initial modulus of 450 g/denier or more.

2. The aromatic polyamide fiber as claimed in claim 1, wherein the surface portion of the filament matrix only in which the extremely fine inorganic particles are dispersed has a depth corresponding to 10% or less of the thickness of the filament.

3. The aromatic polyamide fiber as claimed in claim 1, wherein the depth of the surface portion of the filament matrix only in which the extremely fine inorganic particles are dispersed corresponds to 5% or less of the thickness of the filament.

* * * * *